US005689790A

United States Patent [19]

Kubo et al.

[11] Patent Number: 5,689,790

[45] Date of Patent: Nov. 18, 1997

[54] IMAGE FORMING APPARATUS WITH SPACE PARTICLE LAYER FORMED ON TRANSFER DRUM

[75] Inventors: Takahiro Kubo, Tokyo; Yoshihiro Murasawa, Yokohama; Takashi Hasegawa, Ageo; Satoshi Tamura, Yokohama, all of Japan

[73] Assignee: Canon Kabushiki Kaisha, Tokyo, Japan

[21] Appl. No.: 655,287

[22] Filed: May 15, 1996

Related U.S. Application Data

[63] Continuation of Ser. No. 258,422, Jun. 10, 1994, abandoned.

[30] Foreign Application Priority Data

Jun. 15, 1993 [JP] Japan ..... 5-168590
Jun. 15, 1993 [JP] Japan ..... 5-168591

[51] Int. Cl.[6] ..... G03G 21/00

[52] U.S. Cl. ..... 399/343; 399/303; 399/364

[58] Field of Search ..... 355/271, 326, 355/327, 273, 274, 276, 319

[56] References Cited

U.S. PATENT DOCUMENTS 5,057,873 10/1991 Sawai et al. ..... 355/271
5,084,736 1/1992 Suzuki et al. ..... 355/271
5,086,318 2/1992 Takeda et al. ..... 355/271
5,130,758 7/1992 Takeda et al. ..... 355/315
5,132,737 7/1992 Takeda et al. ..... 355/271
5,172,172 12/1992 Amemiya et al. ..... 355/271
5,210,576 5/1993 Haneda et al. ..... 355/274 X
5,386,278 1/1995 Maeyama et al. ..... 355/271

*Primary Examiner*—R. L. Moses
*Attorney, Agent, or Firm*—Robin, Blecker, Daley and Driscoll

[57] ABSTRACT

The present invention provides an image forming apparatus comprising an image bearing member, and a recording material bearing member for bearing a recording material to convey the recording material to a transfer station where an image is transferred from the image bearing member onto the recording material borne on the recording material bearing member. The recording material bearing member is capable of bearing a plurality of recording materials simultaneously at different positions thereon. The images can be successively transferred onto first and second surfaces of each recording material, and, when images are formed on the second surfaces of the plurality of recording materials, during a time period in which an area of the recording material bearing member with which the first surface of the recording material was previously contacted is passing through at least the transfer position without bearing the recording material, a spacer particle layer is formed between the image bearing member and the area.

26 Claims, 10 Drawing Sheets

IMAGE FORMING APPARATUS WITH SPACE PARTICLE LAYER FORMED ON TRANSFER DRUM

This is a continuation application un 37 CFR 1.62 of prior application Ser. No. 08/258,422 filed on Jun. 10, 1994 (abandoned).

BACKGROUND OF THE INVENTION

1. Field of the Invention

The present invention relates to an image forming apparatus of electrophotographic type or electrostatic type such as a copying machine, a laser printer, a facsimile and the like, and more particularly, it relates to an image forming apparatus for forming an image on a recording material borne on a recording material member.

2. Related Background Art

As full-color image forming apparatuses, various types of image forming apparatuses having a photosensitive drum (image bearing member) and a recording material bearing member for bearing a recording material (sheet) have been proposed and put to practical use. An example of such a full-color image forming apparatus is shown in FIG. 7.

In a full-color copying machine shown in FIG. 7, a photosensitive drum (image bearing member) 1 is mounted for rotation in a direction shown by the arrow, and around the photosensitive drum 1, there are arranged a corona charger 2, an optical system 3, a developing means 4, a transfer device 5 and a cleaning device 14. The optical system 3 comprises an original scanning portion and a color decomposing filter, and for example, is a laser exposure device for illuminating a color-decomposed light image or an equivalent light image E onto the photosensitive drum 1.

A latent image is formed on the photosensitive drum 1 uniformly charged by means of the corona charger 2 by illuminating the color-decomposed light image E for each color. The developing means 4 is of rotatable type and includes four developing devices, i.e., a black developing device 4B*k*, a cyan developing device 4*c*, a magenta developing device 4*m* and a yellow developing device 4*y*, which developing devices are arranged around a central shaft 4*b* so that a desired developing device can be rotated to be opposed to the photosensitive drum 1, thereby developing the latent image on the drum as a toner image. The toner includes resin as a base material.

Further, the toner image formed on the photosensitive drum 1 is transferred onto a recording material supplied from a recording material cassette 7 to a position where the recording material is opposed to the photosensitive drum 1 (through a path shown by the dot line in FIG. 7) by a conveyor system and the transfer device 5. In this example, the transfer device 5 comprises a transfer drum 5*a*, a transfer corona charger 5*b*, a pair of absorb corona charger 5*c* and absorb roller 5*g* for electrostatically absorbing the recording material, an inner corona charger 5*d* and an outer corona charger 5*e*. Further, a peripheral opening of the rotatable transfer drum 5*a* is covered by a cylindrical recording material bearing sheet 5*f* formed from dielectric material.

As the transfer drum 5*a* is rotated, the toner image formed on the photosensitive drum 1 is transferred onto the recording material borne by the recording material bearing sheet 5*f* by means of the transfer charger 5*b*. A desired number of toner images are transferred onto the recording material absorbed and conveyed by the recording material bearing sheet 5*f* to form a full-color image.

After the desired number of toner images are transferred to the recording material in this way, the recording material is separated from the transfer drum 5*a* by a separation means 8, and the separated recording material is sent to the fixing device 9 and then is discharged onto a tray 10. On the other hand, after the transferring operation, the residual toner remaining on the photosensitive drum 1 and the recording material bearing sheet 5*f* is removed by a cleaning device 6 and a transfer cleaner 14, respectively, to prepare for the next image formation.

Further, if a peripheral extent of the transfer drum 5*a* is greater than a length of the recording material by a factor of two or more, an image forming technique wherein two or more recording materials are borne on the recording material bearing sheet 5*f* simultaneously has been adopted to increase the through-put in the continuous image forming mode. For example, if two recording materials can be borne on the recording material bearing sheet simultaneously, when the image formation is effected continuously regarding five recording materials, two recording materials are first borne on the recording material bearing sheet, and then two other recording materials are borne, and finally one recording material is borne (a 2-2-1 sequence).

However, in the conventional image forming method wherein a plurality of recording materials are simultaneously borne on the recording material bearing sheet, particularly when images were formed on both surfaces of each recording material, there arose a problem that fixing oil adhered to the recording material bearing sheet and the photosensitive drum.

To explain this problem in detail, after an image is formed on one surface (first surface) of the recording material, when the toner image is transferred onto the other surface (second surface) of the recording material on the transfer drum, since the fixing oil has already adhered to the first surface of the recording material, such fixing oil is transferred to the recording material bearing sheet 5*f* of the transfer drum 5*a*. Further, the fixing oil transferred to the recording material bearing sheet 5*f* is transferred onto the photosensitive drum 1 when the photosensitive drum 1 is contacted with the recording sheet bearing sheet 5*f* at a transfer station. Thus, if the image forming operation is continued for a plurality of recording materials, the fixing oil will be trapped on the photosensitive drum 1.

When the fixing oil is adhered to the photosensitive drum 1, if normal image formation is effected, due to the viscosity of the fixing oil, the toner will be adhered to an area of the recording material where it should be kept white, thereby causing the fog phenomenon. On the other hand, due to the viscosity of the fixing oil, an adequate quantity of toner will not be transferred from the photosensitive drum 1 to an area of the recording material that should be made black, thereby making the density of the image thinner.

To solve this problem, image forming apparatuses having a cleaning device for removing fixing oil from a recording material bearing sheet of a transfer drum have been proposed.

However, in conventional image forming apparatuses, the fixing oil was removed by the cleaning device after the last color toner image was transferred onto the recording material on the recording material bearing sheet. Accordingly, in the above-mentioned image forming method wherein a plurality of recording materials are borne on the recording material bearing sheet simultaneously, for example, when two recording materials are simultaneously borne on the recording material bearing sheet and an odd number of recording sheets are continuously handled, in the last image formation (effected in a condition that only one recording material is borne on the recording material bearing sheet), it is impossible to prevent the fixing oil trapped on a half portion of the recording material bearing sheet on which the recording is not borne from transferring onto the photosensitive drum. Of course, although the oil trapped on the recording material bearing sheet of the transfer drum can be removed by an oil removing cleaner, if such a removal operation is effected during the image formation, since any shock acts on the transfer drum, the deviation of color components of the image will occur.

On the other hand, even when recording materials of the A3 size (a plurality of such recording materials cannot be borne on the recording material bearing sheet simultaneously) are used, as shown in an image formation sequence in FIG. 8, the removal of toner by means of the transfer cleaner will be effected after the last color toner image was transferred onto the recording material. For example, if a length of the recording material (such as a recording material of A3 size) is longer than a distance between the transfer position and the transfer cleaner, the image formation is still continued when a tip end of the recording material passes through the transfer cleaner. In this condition, if the transfer cleaner is operated, the shock will be generated when the transfer cleaner is contacted with the transfer drum, thereby causing the deviation of the color components of the image.

Accordingly, in order to avoid such inconvenience, the recording material must be separated from the transfer drum during the revolution of the transfer drum in which the last color toner image is being transferred and the recording material bearing sheet must be cleaned during the remainder of that revolution. In this case, however, since there is a time gap between the separation of the recording material and the cleaning of the recording material bearing sheet, the oil remaining on the portion of the recording material bearing sheet from which the recording material is separated is transferred onto the photosensitive drum, with the result that the above-mentioned problem caused by the adhesion of the fixing oil cannot be completely solved.

SUMMARY OF THE INVENTION

An object of the present invention is to provide an image forming apparatus which can prevent fixing oil from transferring from a recording material bearing member to an image bearing member when images are formed on both surfaces of a recording material.

Another object of the present invention is to provide an image forming apparatus which can prevent the poor image formation due to the adhesion of fixing oil to an image bearing member.

A further object of the present invention is to provide an image forming apparatus in which a spacer particle layer is formed between an image bearing member and a recording material bearing member.

The other objects and features of the present invention will be apparent from the following detailed explanation referring to the accompanying drawings.

DETAILED DESCRIPTION OF THE PREFERRED EMBODIMENTS

Now, an image forming apparatus according to a first embodiment of the present invention will be fully explained with reference to the accompanying drawings. In this embodiment, the present invention is embodied as a color image forming apparatus of electrophotographic type.

Figure 1:
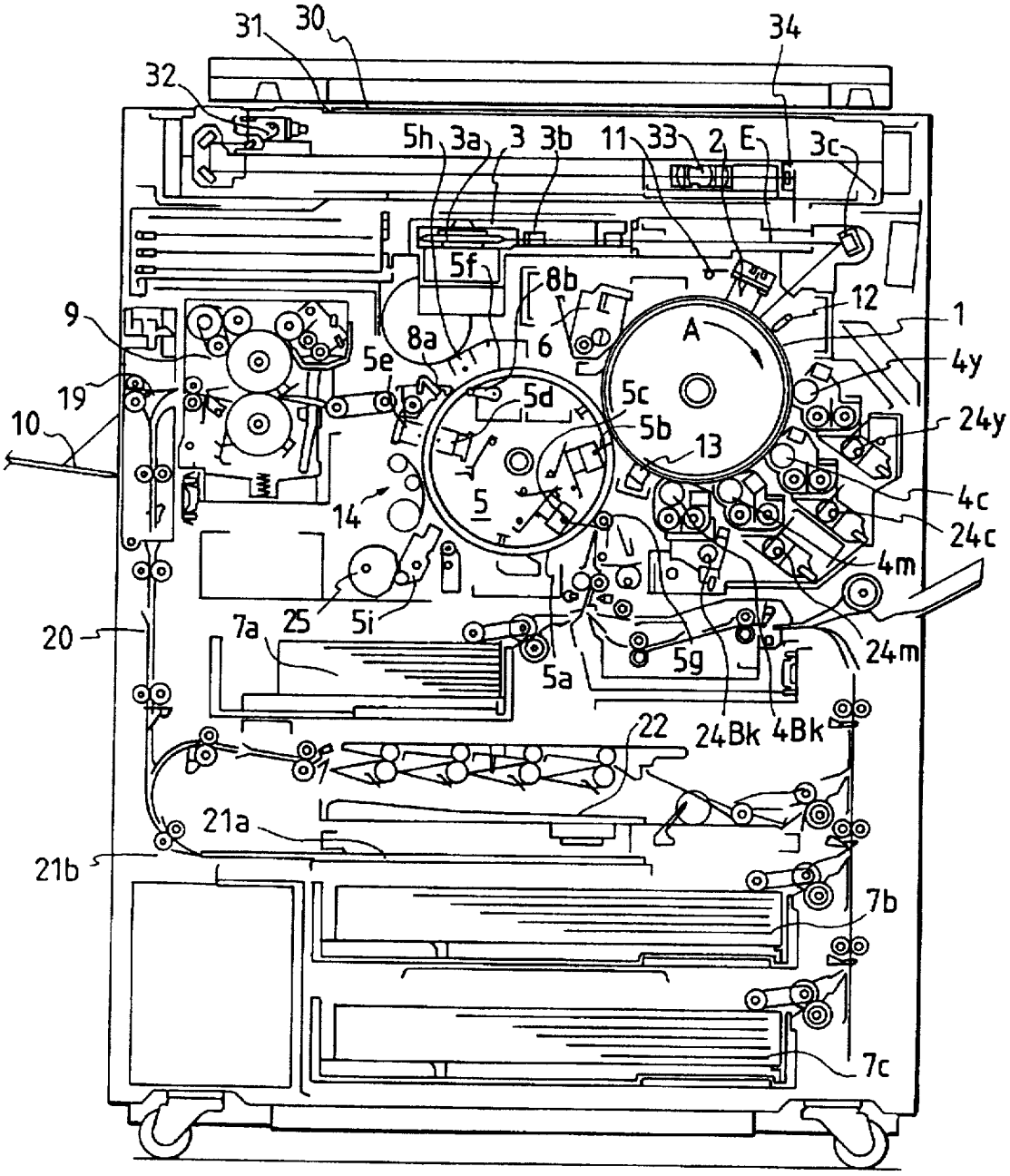
FIG. 1 is an elevational sectional view of an image forming apparatus according to a first embodiment of the present invention.

The image forming apparatus according to the first embodiment shown in FIG. 1 comprises an upper digital color image reader portion and a lower digital color image printer portion.

In the digital color image reader portion, after an original 30 is rested on an original glass support 31, by exposure-scanning a surface of the original by means of an exposure lamp 32, a light image reflected from the original 30 is condensed on a full-color sensor 34 through a lens 33, thereby generating a color-decomposed image signal. The color-decomposed image signal is sent, through an amplification circuit (not shown), to a video treatment unit (not shown), where the signal is processed or treated, and the treated signal is sent to the digital color image printer portion.

In the digital color image printer portion, a photosensitive drum (image bearing member) 1 has a photosensitive body comprised of an organic photoconductive body which will be described later and is supported for rotation in a direction shown by the arrow A. Around the photosensitive drum 1, there are arranged a pre-exposure lamp 11, a corona charger 2, a laser exposure optical system 3, a potential sensor 12, four developing devices 4*y*, 4*c*, 4*m*, 4B*k* containing different color toners, a drum light amount detection means 13, a transfer device 5, and a cleaning device 6.

In the laser exposure optical system 3, the image signal from the reader portion is converted into an image scan exposure light signal by a laser output portion (not shown), and the converted laser light is reflected by a polygon mirror 3*a*. The reflected light is projected onto the photosensitive drum 1 through a lens 3*b* and a mirror 3*c*. When an image is formed in the printer portion, the photosensitive drum 1 is rotated in the direction A and the electric charge on the photosensitive drum is removed by the pre-exposure lamp 11. Then, the photosensitive drum 1 is uniformly charged negatively by the charger 2, and a color-decomposed light image E for each color is illuminated on the photosensitive drum, thereby forming a latent image on the drum.

Then, a selected developing device is operated to reversely develop the latent image formed on the photosensitive drum 1, thereby forming a toner image on the photosensitive drum 1 with negative powder toner including resin as a main component. The developing devices are selectively brought toward the photosensitive drum 1 by respective eccentric cams 24*y*, 24*c*, 24*m*, 24B*k* to develop the latent image.

Thereafter, the toner image formed on the photosensitive drum 1 is transferred onto a recording material supplied from a recording material cassette 7*a*, 7*b* or 7*c* through a conveyor system and the transfer device 5 to a position where the recording material is opposed to the photosensitive drum 1. In the illustrated embodiment, the transfer device 5 comprises a transfer drum 5*a* having a peripheral extent greater than a shorter length (width) of the recording material of A4 size by a factor or two or more, a transfer charger 5*b*, a pair of absorb charger 5*c* and absorb roller 5*g* for electrostatically absorbing the recording material, an inner charger 5*d* and an outer charger 5*e*. Further, a peripheral opening of the rotatable transfer drum 5*a* is covered by a cylindrical recording material bearing sheet 5*f* for bearing the recording material. The recording material bearing sheet 5*f* is formed from dielectric polycarbonate film and the like. Incidentally, a diameter of the photosensitive drum 1 is substantially the same as that of the transfer drum 5*a*.

As the transfer drum 5*a* of the transfer device 5 is rotated, the toner image formed on the photosensitive drum 1 is transferred onto the recording material borne on the recording material bearing sheet 5*f* by the transfer charger 5*b*. In this way, a desired number of color images are transferred to the recording material, thereby forming a full-color image.

In the full-color image formation, after four color toner images were transferred to the recording material in this way, the recording material is separated from the transfer drum 5*a* under the action of a separation pawl 8*a*, a separation push-up roller 8*b* and a separation charger 5*h*, and the separated recording material is sent to a heat roller fixing device 9, where the full-color image is fixed to the recording material. Then, the recording material is discharged onto a tray 10. The four color toner images superposed on the recording material are fused and mixed at the fixing device 9. Further, fixing oil is coated on a fixing roller to which non-fixed toner images formed on the recording material are contacted by an oil impregnated web so that the non-fixed toner images formed on the recording material are prevented from offsetting toward the fixing roller. Accordingly, during the fixing operation, the fixing oil is adhered to a surface (upper surface in the sheet ) of the recording material on which the non-fixed toner images were formed.

On the other hand, after the transferring operation, the residual toner remaining on photosensitive drum 1 is removed by the cleaning device 6 for preparation for the next image formation.

When it is desired to form the images on both surfaces of the recording material by selecting a two-sided image forming mode by an operator, immediately after the recording material is discharged from the fixing device 9, a convey path switching guide 19 is driven so that the recording material is introduced into a reverse rotation path 21*a* through a longitudinal convey path 20. Then, reverse rotation rollers 21*b* are rotated in a reverse direction to return the recording material from the reverse rotation path 21*a* in an opposite direction with a trailing end of the recording material becoming an forward end, thereby temporarily storing the recording material on an intermediate tray 22. Then, during the next image formation, the image is formed on the other surface of the recording material.

Further, a gap between the photosensitive drum 1 and the recording material bearing sheet 5*f* can be appropriately adjusted by a cam follower 5*i* driven by activating an eccentric cam 25 integrally attached to the transfer drum 5*a* at a desired timing. For example, in a stand-by condition or a power-off condition, the transfer drum can be separated from the photosensitive drum.

Figure 2:
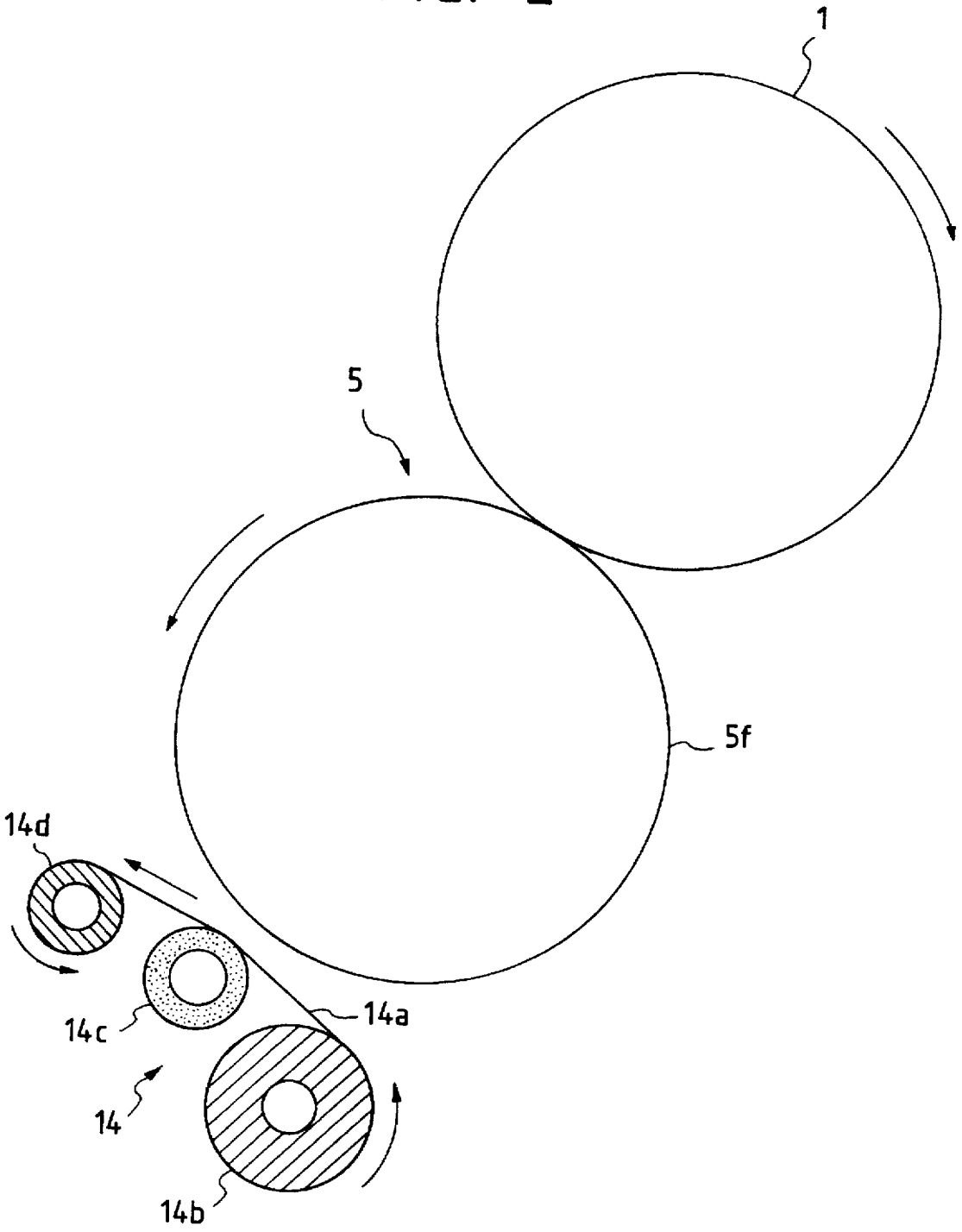
FIG. 2 is an enlarged view showing a transfer cleaner of the image forming apparatus.

Incidentally, in the image forming apparatus according to the illustrated embodiment, there is provided a transfer cleaner 14 for removing residual toner remaining on the recording material bearing sheet 5*f*. The transfer cleaner 14 is of web type as shown in FIG. 2 so that the oil can also be removed from the recording material bearing sheet. In FIG. 2, the transfer cleaner 14 comprises a feed roller 14*b* around which a non-used web 14*a* is wound, an urging member 14*c* for urging the web 14*a* unwound in a direction shown by the arrow against the recording material bearing sheet 5*f* with predetermined pressure, and a take-up roller 14*d* on which the used web 14*a* is wound. With this arrangement, the web 14*a* removes the oil and toner from the recording material bearing sheet 5*f* while sliding on the recording material bearing sheet.

Incidentally, in the illustrated embodiment, material of the web was as follows:

Material of web: non-woven fabric made of synthetic fibers comprised of nylon and polyester Diameter of fiber: average diameter is 4 μm, and a percentage of fibers having diameter of 10 μm or less is 90%

Density of non-woven fabric: 0.17 g/cm$^3$

Average distance between fibers: 2.5 μm

Thickness of non-woven fabric: 500 μm.

By using such a non-woven fabric, the oil could be removed from the recording material bearing sheet 5*f* substantially completely.

Further, the material of fibers forming the non-woven fabric may be polypropylene, layon, acryl, nylon, polyester, vinylon or the combination thereof, as well as the above-mentioned material. It was found that these materials have substantially no technical difference. The fiber density of the non-woven fabric is preferably in a range of 0.05 to 0.80 g/cm$^3$. Particularly, it was found that the non-woven fabric having the fiber density of 0.1 to 0.5 g/cm$^3$ provides excellent oil removing ability.

Incidentally, it was found that the use of woven fabric formed by appropriately weaving the above fibers is undesirable because oil stripes are created in the woven direction of the fabric due to the incomplete removal of oil and because the range of the setting condition of such fabric for use as an oil cleaning member is very narrow. Further, in order to improve oil absorbing ability, the transfer cleaner may be formed from two layers, i.e., an oil removing layer and an oil absorbing layer. In addition, the transfer cleaner is not limited to the web but may be a roller, which achieves the same technical effect as the web. When the transfer cleaner is formed from the roller, the entire apparatus can be made more compact in comparison with the transfer cleaner of web type.

Next, the image formation sequence (for forming the images on the first and second surfaces of the recording material) of the image forming apparatus according to the illustrated embodiment will be explained with reference to a sequence chart shown in FIG. 3. In this case, an example that the images are continuously formed on five recording materials of the A4 size by using the transfer drum capable of bearing two recording materials of the A4 size simultaneously will be described. Incidentally, even when the five recording materials are handled continuously, an image formation start signal is inputted to the apparatus once.

Figure 3:
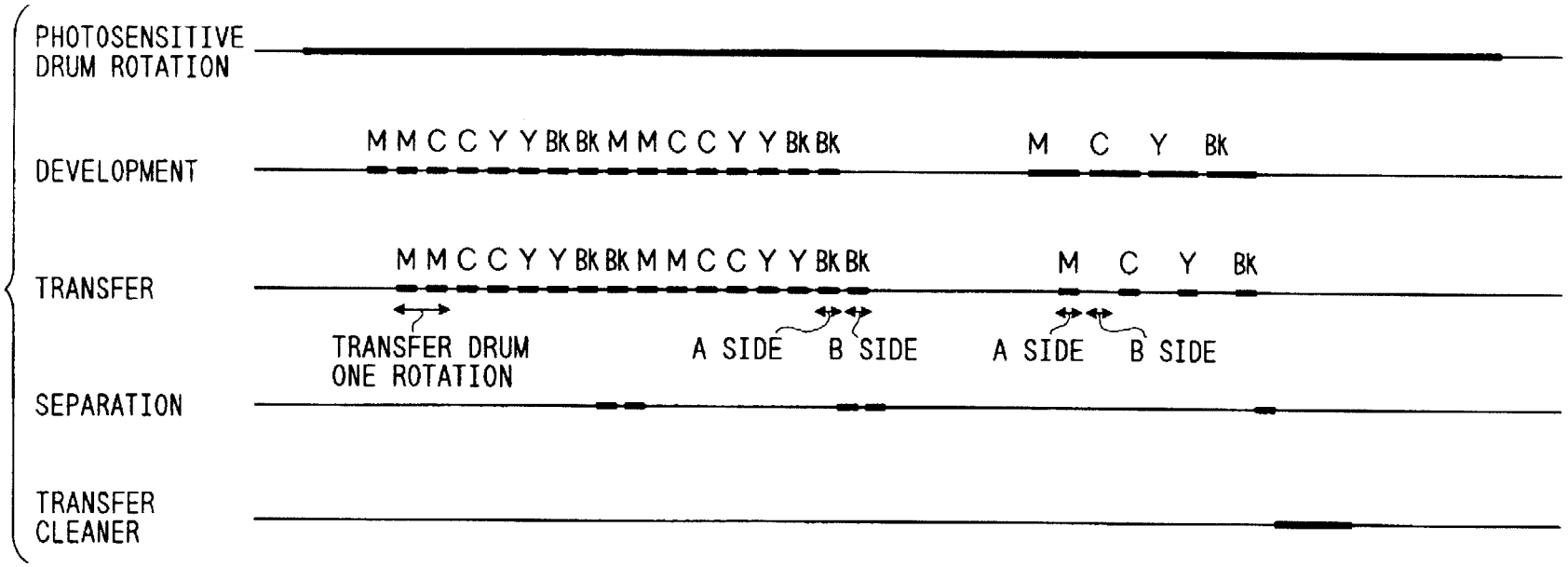
FIG. 3 is a sequence chart when images are continuously formed on an odd number of recording materials having a small size.

As shown in FIG. 3, two recording materials are borne on the transfer drum in the first image formation and two recording materials are also borne on the transfer drum in the second image formation, and only a single recording material is borne on the transfer drum in the third or last image formation. Now, an area of the transfer drum on which a first recording material is borne is referred to as "A side" and an area of the transfer drum on which a second recording material is borne is referred to as "B side" when two recording materials are borne on the transfer drum simultaneously. During the time when the last image is being formed, i.e. when four color images are being formed on the fifth recording material borne on the A side of the transfer material in the illustrated embodiment, regarding an area of the photosensitive drum corresponding to the B side (image non-forming area) of the transfer drum on which the recording material is not borne, the light illumination by the optical system and the development by means of the developing device are effected. After the toner images are transferred onto the back surface (second surface) of the fourth recording material, the fixing oil is adhered to the A side and the B side of the recording material bearing sheet *5f*. When the toner image is transferred onto the fifth recording material, since the recording material is born on the A side of the recording material bearing sheet *5f*, the fixing oil adhered to the A side of the recording material bearing sheet is not transferred onto the photosensitive drum.

To the contrary, by developing the area of the photosensitive drum corresponding to the B side of the transfer drum with toner during the last image formation (for the last or fifth recording material), since a toner layer is formed on that area, it is possible to block or prevent the fixing oil trapped on the B side of the recording material bearing sheet *5f* from transferring to the photosensitive drum due to the presence of the toner particles. The reason is that, since the diameter of the toner particle (average particle diameter is 8 μm in the illustrated embodiment) is greater than a thickness of the oil layer (about 2 to 3 μm in the illustrated embodiment), the toner particles act as spacer particles to prevent the oil from transferring to the photosensitive drum. Further, since the development on the area of the photosensitive drum 1 corresponding to the B side of the transfer drum is performed to achieve the above-mentioned blocking effect, so-called vacant development wherein the latent image is not formed on the photosensitive drum may be performed to reduce the toner consumption, in place of the above-mentioned development performed while decreasing the potential on the drum by illumination of laser light. Even when such vacant development is performed, since so-called "fog" occurs so that the toner is adhered to the photosensitive drum at the developed portion, an adequate spacer effect can be obtained. After the vacant development, the developing device is mechanically separated from the photosensitive drum 1 completely so that further adhesion of toner to the drum is prevented.

Further, after the last color (black in the illustrated embodiment) toner image is transferred onto the recording material borne on the A side of the transfer drum during the last image formation regarding the fifth recording material, the recording material is separated from the-transfer drum during the same revolution of the transfer drum and the transfer cleaner is driven to be contacted with the transfer drum. Since the B side of the transfer drum passes through the transfer station while the A side of the transfer drum is being cleaned by the transfer cleaner, in the illustrated embodiment, the transferring of oil to the photosensitive drum is prevented by the vacant development with the black toner Bk.

Figure 4:
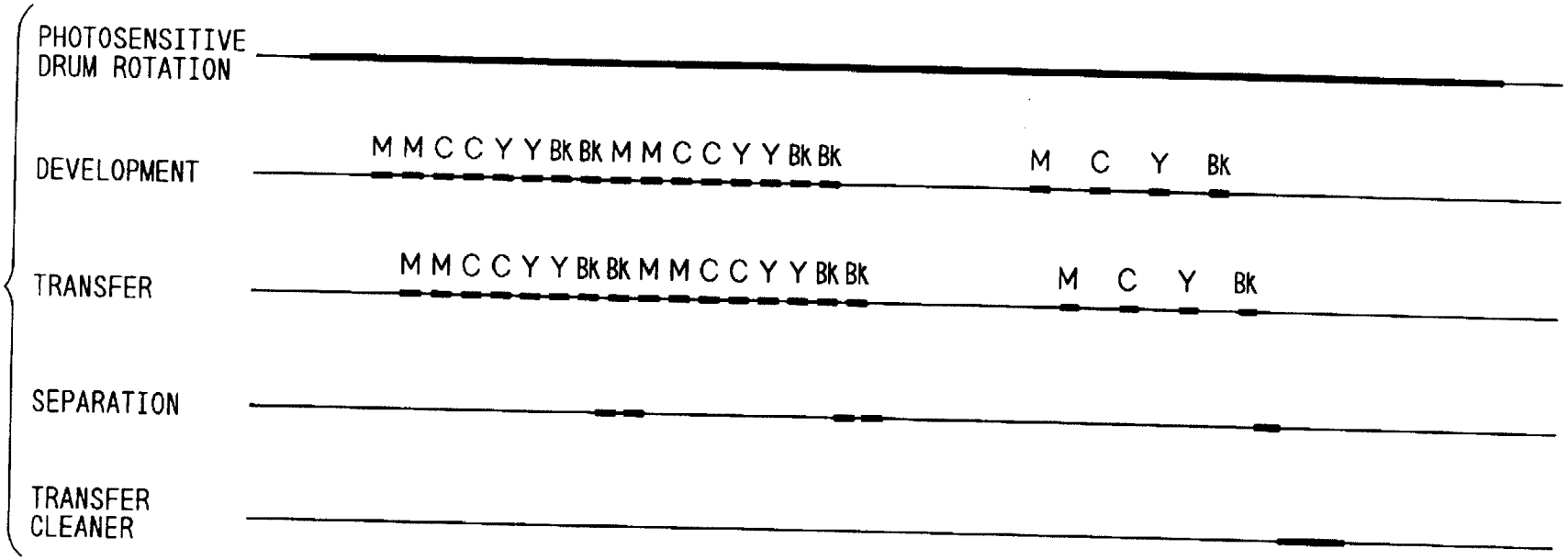
FIG. 4 is a sequence chart similar to FIG. 3, when images are continuously formed on an odd number of recording materials having a small size.

Next, to understand the illustrated embodiment more clearly, the image formation sequence regarding the first and second recording materials in an image forming apparatus wherein the spacer particle layer is not formed will be explained with reference to a sequence chart shown in FIG. 4. Also in this case, similar to the illustrated embodiment, although two recording materials are borne on the transfer drum in the first image formation and two recording materials are also borne on the transfer drum in the second image formation, and only a single recording material is borne on the transfer drum in the third or last image formation, during the time when the last image is being formed, i.e. when four color images are being formed on the fifth recording material borne on the A side of the transfer material, regarding the area of the photosensitive drum corresponding to the B side (image non-forming area) of the transfer drum, the development is not effected. Further, after the last color (black in this case) toner image is transferred onto the recording material borne on the A side of the transfer drum during the last image formation regarding the fifth recording material, the recording material is separated from the transfer drum during the same revolution of the transfer drum and the transfer cleaner is driven. In this case, since the B side of the transfer drum passes through the transfer station while the image formation is being effected on the A side of the transfer drum and the A side is being cleaned, the further image formation is badly influenced.

Next, the image formation sequence (for forming the images on the first and second surfaces of the recording material) of the image forming apparatus according to the illustrated embodiment will be explained with reference to a sequence chart shown in FIG. 5, regarding an example that the images are continuously formed on six recording materials having A4 size by using the above-mentioned transfer drum.

Figure 5:
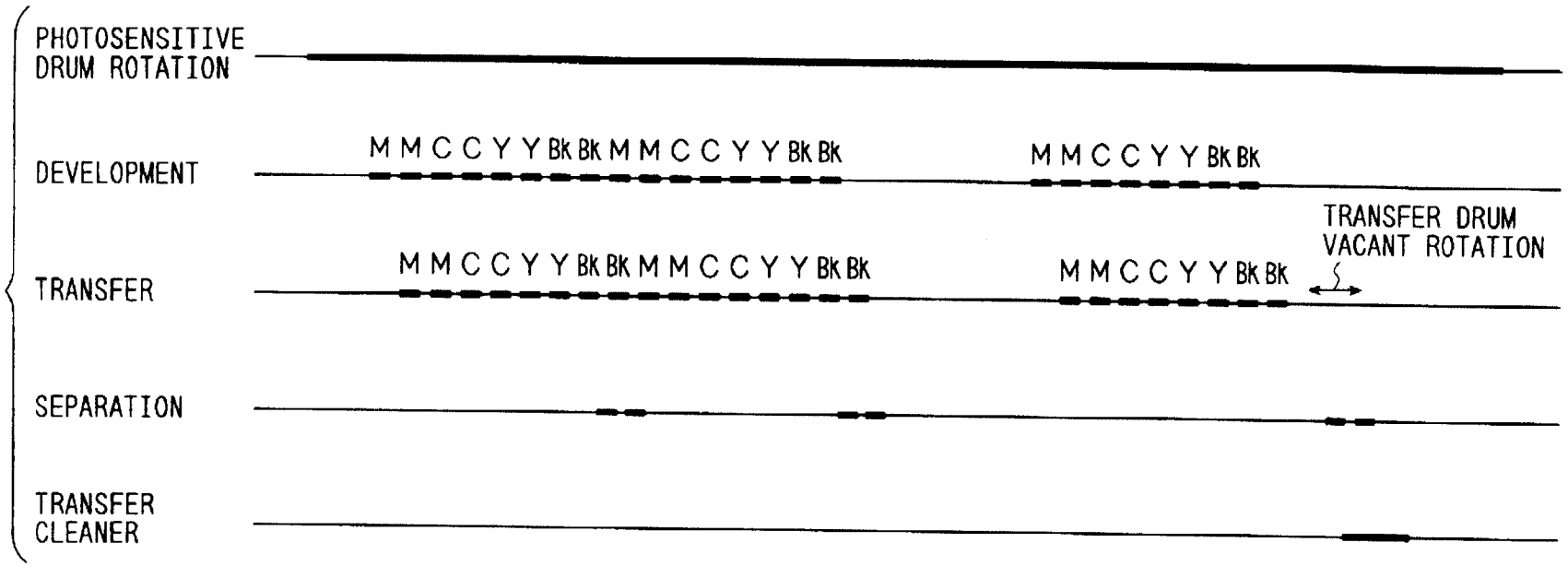
FIG. 5 is a sequence chart when images are continuously formed on an even number of recording materials having a small size.

In this case, as shown in FIG. 5, since two recording materials are always borne on the transfer drum in the first to third image formation operations, and thus, there is no image non-forming area on photosensitive drum corresponding to A side or B side of the transfer drum, the vacant development is not effected, unlike to the case where five recording materials are continuously handled. However, in this case, the apparent length of the recording material is increased by bearing two recording materials on the transfer drum. Thus, since the last color toner image is still being transferred onto the second recording material when the tip end of the first recording material passes through the cleaning station for the recording material bearing sheet, if the transfer cleaner is operated at this point, the deviation of color component will occur due to any shock. Accordingly, when two recording materials are always borne on the transfer drum, after the transferring operation, the vacant rotation of the transfer drum is effected while bearing the recording materials. Thereafter, the recording material bearing sheet is cleaned during the same revolution of the transfer drum as the revolution during which the recording material is separated from the drum.

Incidentally, since the image formation sequence of the conventional image forming apparatus in the case where six recording materials are continuously handled with two recording materials always borne on the transfer drum is the same as the above-mentioned image formation sequence, explanation thereof will be omitted.

As mentioned above, by using the image formation sequence including the vacant development, in the above-mentioned image forming apparatus wherein the images are transferred onto two recording materials which are simultaneously borne on the transfer drum, it is possible to eliminate the conventional drawback which would be caused due to the transferring of the fixing oil to the photosensitive drum when the images are formed on both surfaces of the recording materials.

Next, an image forming apparatus according to a second embodiment of the present invention will be explained with reference to FIG. 6. Incidentally, in the second embodiment, only the portions different from the first embodiment will be described.

The feature of the second embodiment is that the transfer cleaner 14 of the first embodiment is improved. That is to say, in the transfer cleaner 14 of the first embodiment, the single cleaner of web type or roller type was used. Since such a cleaner is slidingly contacted with the recording material bearing sheet 5*f* of the transfer drum 5*a* strongly, it is not preferable in consideration of the service life of the recording material bearing sheet. Further, although such sliding cleaning is required to remove the fixing oil, if the toner alone is removed, soft cleaning (such as a fur brush cleaner) for cleaning the recording material bearing sheet relatively softly may be used.

Figure 6:
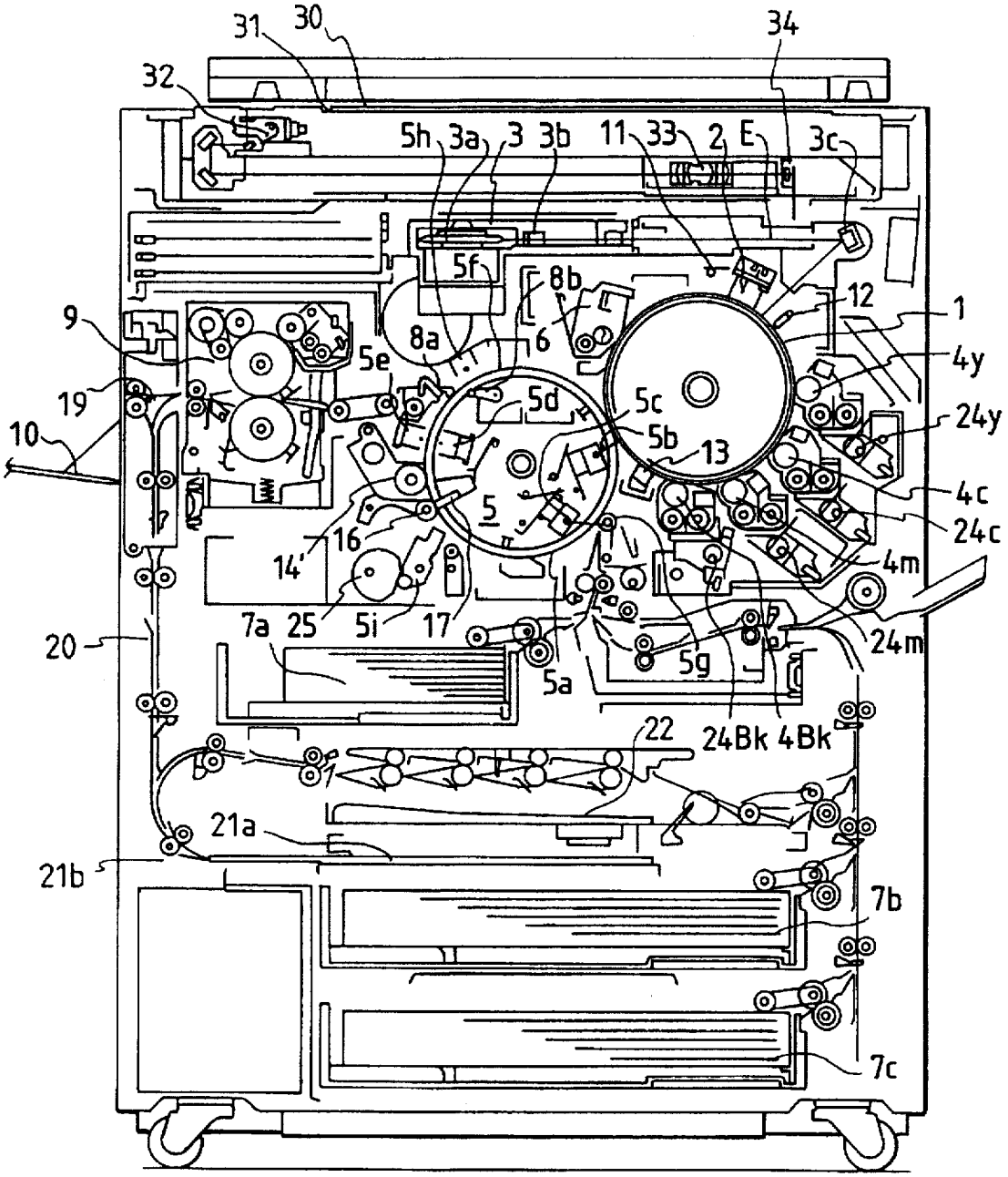
FIG. 6 is an elevational sectional view of an image forming apparatus according to a second embodiment of the present invention.
Figure 7:
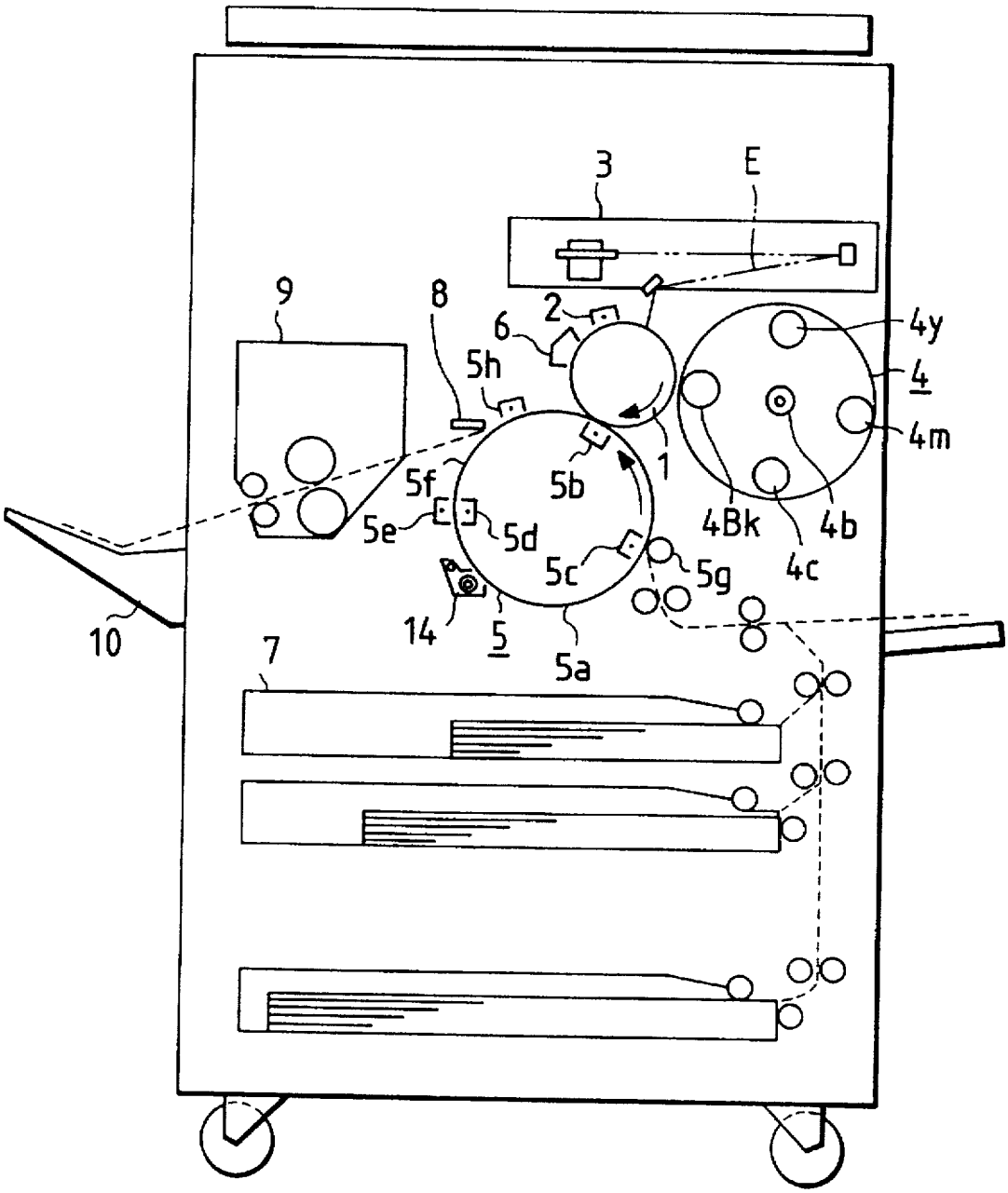
FIG. 7 is a schematic sectional view of a conventional image forming apparatus.

Thus, in the second embodiment, as shown in FIG. 6, a fur brush cleaner 14' for removing toner and a cleaner 16 for removing oil are both used. Incidentally, the oil removing cleaner 16 may be of web type or roller type as is in the first embodiment.

Further, since the oil removing cleaner 16 is slidingly contacted with the recording material bearing sheet 5*f*, it is preferable that the cleaner 16 is operated only in the two-sided image formation mode. Further, it is preferable that the oil removing cleaner is used together with the toner removing cleaner 14' to prevent toner from clogging the cleaner 16. Accordingly, the oil removing cleaner 16 is preferably arranged at a downstream side of the toner removing cleaner 14' in a rotational direction of the transfer drum 5*a*.

Incidentally, since the image formation sequence in the second embodiment is the same as that in the first embodiment, explanation thereof will be omitted. Also in this second embodiment, by using the above-mentioned image formation sequence, not only deviation of color component but also the adverse effect upon the image due to transfer of oil can be prevented.

Next, a third embodiment of the present invention will be explained. The third embodiment relates to an image forming apparatus for forming images on recording materials while bearing three or more recording materials on a transfer drum simultaneously. For example, when small-size recording materials (for example, B5 size) are used and a transfer drum has a peripheral length greater than a length of the recording material of B5 size by three times or more, three recording materials are borne on the transfer drum simultaneously.

In this case, for example, when the images are formed on eight recording materials continuously, three recording materials are borne on the transfer drum in the first image formation, three recording materials are borne on the transfer drum in the second image formation, and two recording materials are borne on the transfer in the last or third image formation. Thus, in the last image formation, regarding an area (image non-forming area) of the photosensitive drum corresponding to an area of the transfer drum on which the recording material is not borne, the vacant development is performed.

By using the above-mentioned image formation sequence, even when the images are transferred onto three or more recording materials which are simultaneously borne on the transfer drum, it is possible to prevent the adverse effect upon the image due to transfer of the fixing oil to the photosensitive drum.

Figure 8:
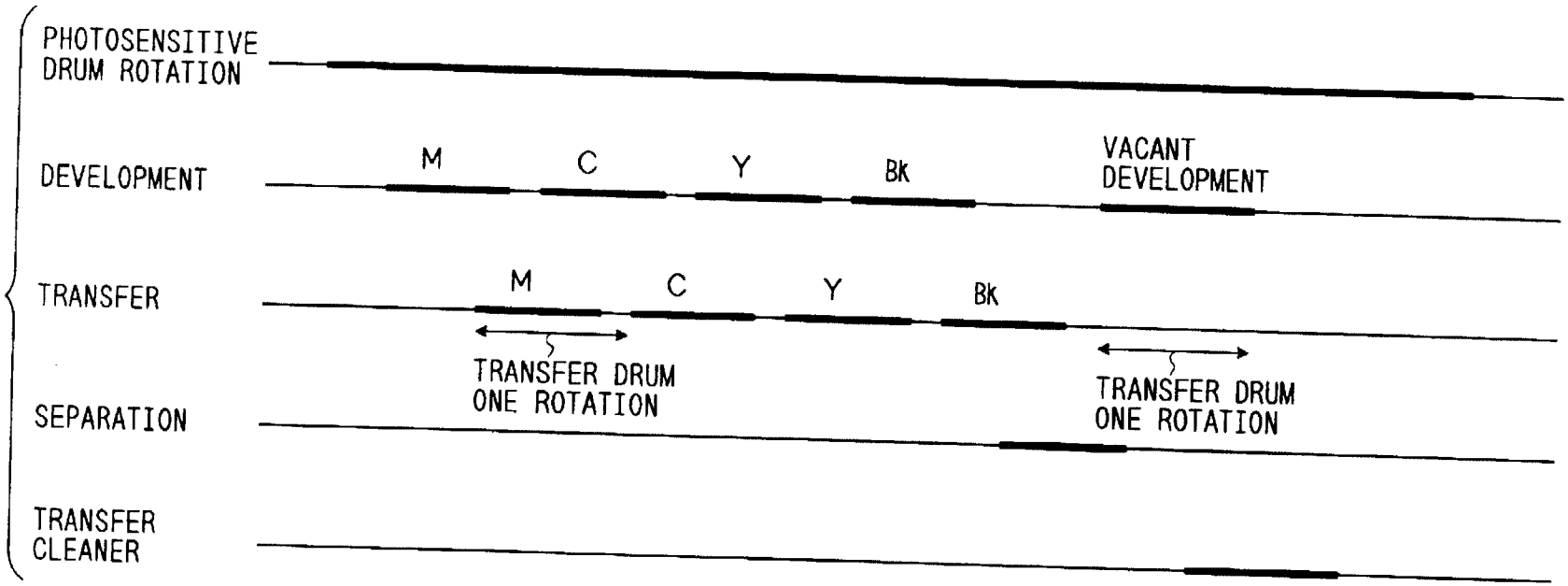
FIG. 8 is a sequence chart when an image is formed on a recording material having a large size.

While an example that the images are formed on the recording materials of the A4 size was explained, in the image forming apparatus shown in FIG. 1, the image formation sequence for forming the images on the first and second surface of a recording material having A3 size will be explained with reference to a timing chart shown in FIG. 8. In the image formation sequence according to this example, as shown in FIG. 8, the transferring of the last color toner image and the separation of the recording material are effected during the same revolution of the transfer drum, and the development is also effected. The cleaning of the recording material bearing sheet is effected during the remainder of that revolution.

When the image is transferred onto the back surface (second surface) of the recording material, since the first surface of the recording material is borne on the recording material bearing sheet 5*f*, the fixing oil is adhered to an area of the recording material bearing sheet 5*f* which is contacted with the first surface of the recording material. Immediately after the black toner image is transferred to the recording sheet, the recording material is separated from the transfer drum at the separation station. However, if the cleaner 14 is contacted with the recording material bearing sheet 5*f* while the image is being transferred onto the recording material, the deviation of color component of the image will occur due to the vibration. Accordingly, it is desirable that the cleaner 14 is contacted with the recording material bearing sheet after the black toner image was transferred to the recording material.

However, when the recording material having A3 size is used, after the transferring of the black toner image is completed, a forward end of the area (to which the fixing oil was adhered) of the recording material bearing sheet with which the first surface of the recording material was contacted has already passed through the cleaning station of the cleaner 14. Accordingly, the spacer particle layer is formed between the photosensitive drum 1 and the recording material bearing sheet at least during the area (to which the fixing oil was adhered) of the recording material bearing sheet with which the first surface of the recording material was contacted as that area is passing through the transfer station. The spacer particle layer is formed by developing the photosensitive drum 1 with toner by means of the developing device. On the other hand, the cleaner 14 may be contacted with the recording material bearing sheet 5*f* before the forward end of the area (to which the fixing oil was adhered) of the sheet reaches the cleaning station of the cleaner 14 during the next revolution of the transfer drum (for example, immediately after one revolution (from the start of the separation of the recording material) of the transfer drum is completed).

By effecting such developing operation, it is possible to block or prevent the oil trapped on the recording material bearing sheet from transferring to the photosensitive drum due to the presence of the toner particles. The reason is that, since the diameter of the toner particle (about 8 μm in this example) is greater than the thickness of the oil layer (about 2 to 3 μm in this example), the toner particles act as spacer particles to prevent the oil from transferring to the photosensitive drum.

Further, since such development is performed to achieve the above-mentioned blocking effect, so-called vacant development wherein the latent image is not formed on the photosensitive drum may be performed to reduce the toner consumption. Even when such vacant development is performed, since so-called "fog" occurs so that the toner is adhered to the photosensitive drum at the developed portion, the adequate spacer effect can be obtained.

Incidentally, the image formation sequence shown in FIG. 8 may be applied to the apparatus shown in FIG. 6.

The image formation sequence shown in FIG. 8 is desirably performed when a length of the recording material along the recording material bearing sheet is greater than the peripheral length of the recording material bearing sheet between the transfer station and the cleaning station of the transfer cleaner for removing the fixing oil in a rotational direction of the transfer drum.

As mentioned above, by using the image formation sequence including the vacant development, it is possible to prevent the adverse effect upon the image due to the transferring of the oil to the photosensitive drum which was caused conventionally when the images were formed on both surfaces of the recording material.

In FIG. 8, while the image formation sequence wherein a single recording material having a large size is borne on the transfer drum was explained, as mentioned above, when the peripheral length of the transfer drum is greater than the length of the recording material by twice or more, an image forming technique wherein two or more recording materials are borne on the recording material bearing sheet simultaneously has been adopted to increase the through-put in the continuous image formation. For example, if two recording materials having a small size can be borne on the recording material bearing sheet simultaneously, when the image formation is effected continuously regarding five recording materials, two recording materials are initially borne on the recording material bearing sheet, and then two other recording materials are borne, and finally one recording material is borne (a 2-2-1 sequence).

Now, such image formation will be explained with reference to a side view of the apparatus shown in FIG. 9 and an image formation sequence chart shown in FIG. 10, regarding recording materials having A4 size.

Figure 9:
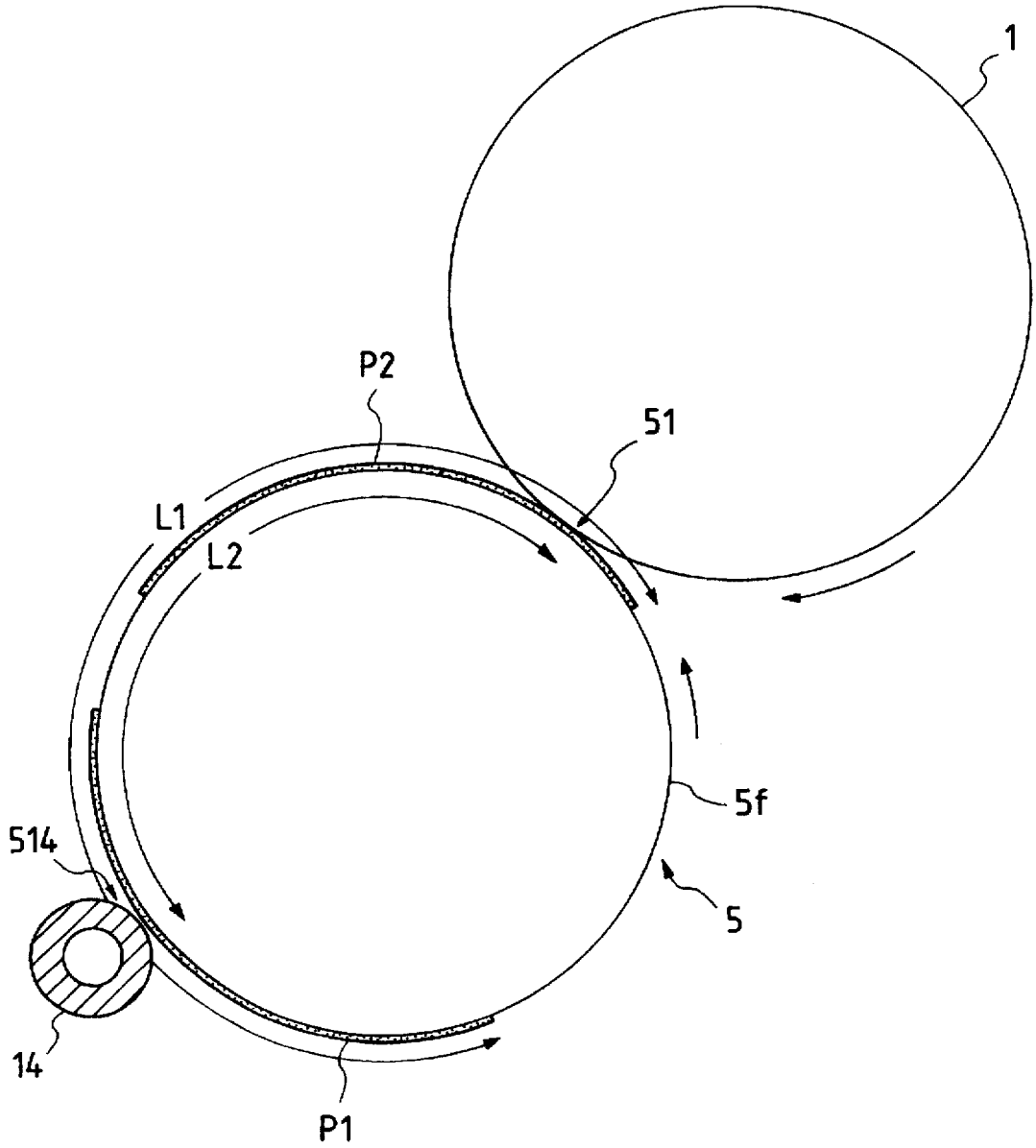
FIG. 9 is a schematic view showing a condition that a plurality of recording materials having a small size are simultaneously borne on a transfer drum.

In this case, as shown in FIG. 9, since the recording materials P1, P2 are simultaneously borne on the transfer drum, the apparent total length of the recording materials becomes greater than the sum of the lengths of two recording materials as shown. That is, the apparent length L1 corresponds to a distance between a tip end of the first recording material P1 and a trailing end of the second recording material P2. This distance is greater than a distance L2 between a transfer station 51 and a transfer cleaning station 514. Accordingly, when the first recording material P1 passes through the transfer cleaning station 514, the last color toner image is still being transferred onto the second recording material P2. During the transferring of the last color toner image to the second recording material, if the transfer cleaner 14 is operated, since the transfer cleaner 14 is contacted with the transfer drum 5, the deviation of color component of the image will occur due to any shock. To avoid this, although the transferring of the last color toner image to the recording material and the separation of the recording material are effected during the same revolution of the transfer drum, the cleaning operation of the transfer cleaner is effected in a further revolution of the transfer drum.

In this case, however, as mentioned above, since there is a time gap between the separation operation and the cleaning operation of the transfer cleaner, the fixing oil adhered to an area of the recording material bearing sheet from which the first recording material P1 was separated is transferred onto the photosensitive drum. To avoid this, in the image formation sequence according to this example, as shown in FIG. 10, the transferring of the last color toner image to the recording material and the separation of the recording material are effected during the same revolution of the transfer drum and the developing operation is also effected, and the cleaning operation of the transfer cleaner is effected in the further revolution of the transfer drum.

As mentioned above, also in the image formation wherein two recording materials are simultaneously borne on the transfer drum, by using the above-mentioned image formation sequence, it is possible to prevent the adverse effect upon the image due to the transferring of the fixing oil to the photosensitive drum.

Figure 10:
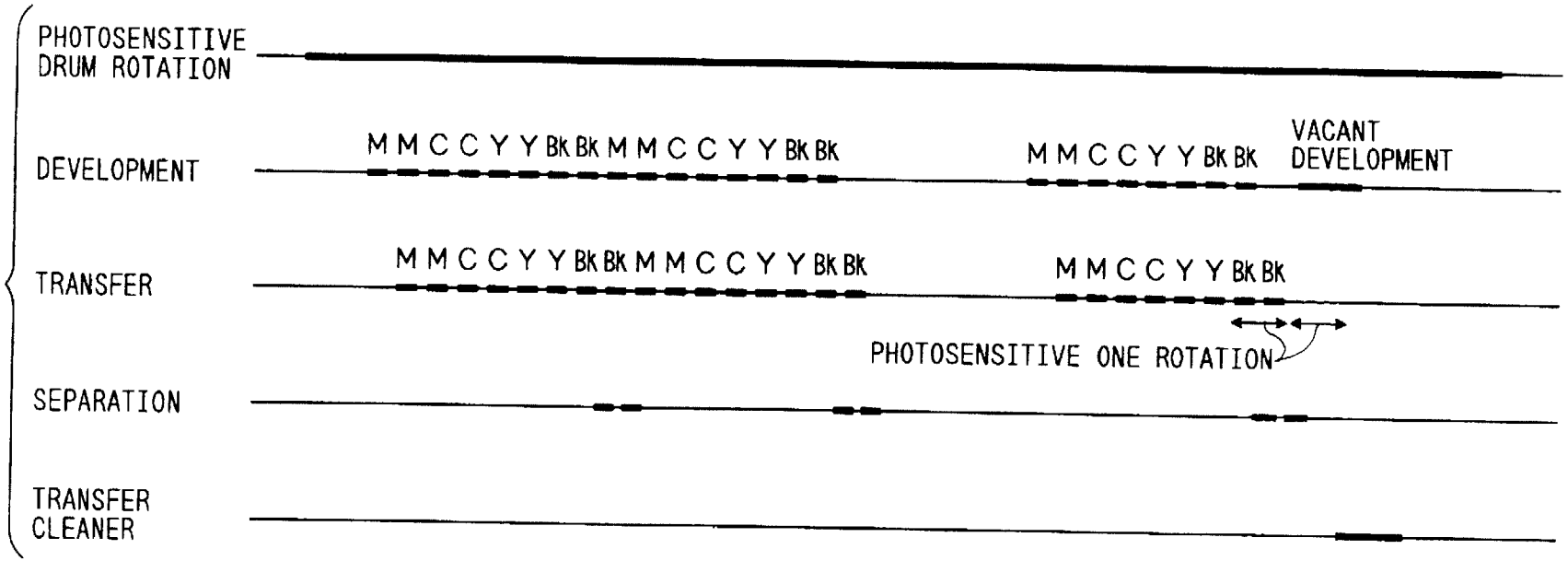
FIG. 10 is a sequence chart when images are continuously formed on an even number of recording materials having a small size.

It is desirable that the image formation sequence shown in FIG. 10 is effected when the apparent total length L1 of the recording materials (distance between a tip end of a first recording material and a trailing end of a last recording material when a plurality of recording materials are simultaneously borne on a transfer drum) is greater than at least a peripheral distance between the transfer station and the cleaning station of the transfer cleaner for removing the fixing oil along the rotational direction of the recording material bearing sheet.

Incidentally, in the above-mentioned embodiments, while the spacer particle layer was formed by the black toner in the full-color (four-color) mode, if a mono-color mode is selected, the spacer particle layer may be preferably formed by that color toner, and, if a three-color (yellow, magenta, cyan) mode is selected, the spacer particle layer may be formed by the last color (cyan) toner. That is to say, it is preferable that the spacer particle layer is formed by color toner which is to be transferred onto the recording material last.

Further, in the above-mentioned image formation sequences, when the images are formed on both surfaces of the recording material, it is desirable that the transfer cleaner 14 is kept separated from the recording material bearing sheet from after the last color image was transferred to the first surface of the recording material to before the first color image is transferred onto the second surface of the recording material.

As apparent from the foregoing description, in the image forming apparatus according to the present invention, in the case where the images are formed on both surfaces of the recording materials, at least in the back surface (second surface) image formation, when a plurality of recording materials are borne on the transfer drum simultaneously, by developing the image bearing member including the image non-forming area during the last image formation, since the fixing oil trapped on the recording material bearing member can be prevented from transferring to the image bearing member through the image non-forming area, the contamination of the image bearing member and a recording material bearing member with oil can be prevented, and thus, it is possible to obtain the good image without fog and/or poor density.

Further, in the image forming apparatus according to the present invention, in the case where the images are formed on both surfaces of the recording materials, at least in the back surface (second surface) image formation, since the developing operation is effected between the separation operation and the cleaning operation effected during the further revolution of the transfer drum by effecting the developing operation regarding the image bearing member during the rotation of the recording material bearing member for separating the recording material, it is possible to prevent the oil trapped on the recording material bearing sheet from transferring to the image bearing member due to the presence of toner, and thus, to obtain the good image.

The present invention is not limited to the aforementioned embodiments, and various alterations and modifications can be effected within the scope of the present invention.

What is claimed is:

1. An image forming apparatus comprising:

an image bearing member; and a recording material bearing member for bearing a recording material to convey it to a transfer station where an image is transferred from said image bearing member onto the recording material, said recording material bearing member being capable of bearing a plurality of recording materials simultaneously at different positions thereon;

wherein said apparatus is operable in a mode in which respective images are successively transferred onto first and second surfaces of each recording material, and, in said mode, when images are formed on the second surfaces of the plurality of recording materials, during a time period in which an area of said recording material bearing member with which the first surface of the recording material was previously contacted is passing through at least said transfer station without bearing the recording material, spacer particles are provided between said image bearing member and said area on said recording material bearing member to prevent transfer of oil to said image bearing member from said area on said recording material bearing member.

2. An image forming apparatus according to claim 1, further comprising developing means for developing said image bearing member with toner, and wherein the spacer particles are formed from the toner.

3. A image forming apparatus according to claim 2, wherein, when images are continuously transferred onto the second surfaces of the plurality of recording materials, one of said plurality of recording materials is borne on a portion of said recording material bearing member adjacent to said area of said recording material bearing member and an image is formed on said one recording material.

4. An image forming apparatus according to claim 3, wherein an image formed on said image bearing member during a time period in which, the recording material borne on said portion adjacent to said area on said recording material bearing member is passing through said transfer station, and said spacer particles formed on said recording material bearing member during a time period in which said area on said recording material bearing member is passing through said transfer station are formed by toner having the same color.

5. An image forming apparatus according to claim 1, wherein said apparatus is provided contactable with and separable from said recording material bearing member and having cleaning means for removing the oil therefrom, and wherein, when the images are continuously transferred onto the plurality of recording materials, said cleaning means is kept separated from said recording material bearing member until the transferring of the image to a last recording material among said plurality of recording materials is completed.

6. An image forming apparatus according to claim 1, wherein said spacer particles are formed when the number of recording materials borne on said recording material bearing member is simultaneously decreased during an operation in which images are being continuously transferred onto the second surfaces of the plurality of recording materials.

7. An image forming apparatus according to claim 1, wherein images having different colors can be transferred in a superposed manner onto the recording material borne on said recording material bearing member.

8. An image forming apparatus according to claim 7, wherein a full-color image can be formed on the recording material.

9. An image forming apparatus according to claim 2, wherein said spacer particles are formed on an area of said image bearing member on which a latent image is not formed.

10. An image forming apparatus according to claim 1, further comprising cleaning means for cleaning said recording material bearing member, said cleaning means selectively in contact with and separable from said recording material bearing member, and wherein said spacer particles are formed between said image bearing member and said area on said recording material bearing member during a time period in which said area is passing through said transfer station without bearing the recording material thereon and is not cleaned by said cleaning means.

11. An image forming apparatus comprising:

an image bearing member; and a recording material bearing member for bearing a recording material to convey it to a transfer station where an image is transferred from said image bearing member onto the recording material;

wherein said apparatus is operable in a mode in which respective images are successively transferred onto first and second surfaces of each recording material, and, in said mode, when the recording material is separated from said recording material bearing member after the respective image was transferred to the second surface of the recording material, during a time period in which an area of said recording material bearing member with which the first surface of the recording material was previously contacted is passing through at least said transfer station without bearing the recording material, a spacer particle layer is formed between said image bearing member and said area on said recording material bearing member to prevent transfer of oil to said image bearing member from said area on said recording material bearing member.

12. An image forming apparatus according to claim 11, wherein said apparatus is provided contactable with and separable from said recording material bearing member and having cleaning means for removing the oil therefrom.

13. An image forming apparatus according to claim 11, further comprising developing means for developing said image bearing member with toner, and wherein the spacer particle layer is formed from the toner.

14. An image forming apparatus according to claim 12, wherein when a total extent of the recording material(s) in a circumferential direction on said recording material bearing member is (are) greater than a distance between said transfer station and said cleaning means, said spacer particle layer is formed.

15. An image forming apparatus according to claim 14, wherein said apparent total length corresponds to a length between a tip end of a first recording material and a trailing end of a last recording material when a plurality of recording materials are simultaneously borne on said recording material bearing member.

16. An image forming apparatus according to claim 14, wherein said apparent total length corresponds to a length between a tip end of a recording material and a trailing end of said recording material when single recording material is borne on said recording material bearing member.

17. An image forming apparatus according to claim 12 or 14, wherein said cleaning means is kept separated from said recording material bearing member during an image transferring operation.

18. An image forming apparatus according to claim 17, wherein said cleaning means is contacted with said recording material bearing member after said image transferring operation is finished.

19. An image forming apparatus according to claim 11, wherein a plurality of recording materials can be borne on said recording material bearing member simultaneously, and, when images are formed on the second surfaces of the plurality of recording materials, during a time period in which an area of said recording material bearing member with which the first surface of the recording material was previously contacted is passing through at least said transfer position without hearing the recording material, a spacer particle layer is formed between said image bearing member and said area on said recording material bearing member to prevent transfer of oil to said image bearing member from said area on said recording material bearing member.

20. An image forming apparatus according to claim 19, wherein said apparatus is provided contactable with and separable from said recording material bearing member and having cleaning means for removing the oil therefrom, and wherein, when the images are continously transferred onto the plurality of recording materials, said cleaning means is kept separated from said recording material bearing member until the transferring of the image to a last recording material among said plurality of recording materials is completed.

21. An image forming apparatus according to claim 19, wherein said spacer particle layer is formed when the number of recording materials borne on said recording material bearing member is simultaneously decreased during an operation in which images are being continuously transferred onto the second surface of the plurality of recording materials.

22. An image forming apparatus according to claim 11, wherein images having different colors can be transferred in a superposed manner onto the recording material borne on said recording material bearing member.

23. An image forming apparatus according to claim 22, wherein a full-color image can be formed on the recording material.

24. An image forming apparatus according to claim 13, wherein said spacer particle layer is formed on an area of said image bearing member on which a latent image is not formed.

25. An image forming apparatus according to claim 11, wherein said apparatus is provided contactcable with and separable from said recording material to remove oil therefrom, and wherein said spacer particle layer is formed between said image bearing member and said area on said recording material bearing member during a time period in which said area is passing through said transfer station in a condition that said area does not bear the recording material thereon and is not cleaned by said cleaning means.

26. An image forming apparatus according to claim 18, wherein during the operation in which the respective image is transferred to the recording material, the separation of the recording material from said recording material bearing member is started.

* * * * *

UNITED STATES PATENT AND TRADEMARK OFFICE

CERTIFICATE OF CORRECTION

PATENT NO. : 5,689,790

DATED : November 18, 1997

INVENTOR(S) : Kubo et al.

It is certified that error appears in the above-identified patent and that said Letters Patent is hereby corrected as shown below:

Col. 8, line 1, delete "the-transfer" and insert -- the transfer --.

Col. 15, line 22, delete "hearing" and insert -- bearing --.

Signed and Sealed this

Twenty-sixth Day of May, 1998

*Attest:*

*Attesting Officer*

BRUCE LEHMAN

*Commissioner of Patents and Trademarks*